US008549961B2

(12) United States Patent
Huang

(10) Patent No.: US 8,549,961 B2
(45) **Date of Patent: *Oct. 8, 2013**

(54) ADJUSTABLE WRENCH

(75) Inventor: Ping-Wen Huang, Taichung (TW)

(73) Assignee: New Way Tools Co., Ltd., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/591,423

(22) Filed: Aug. 22, 2012

(65) Prior Publication Data

US 2012/0312129 A1 Dec. 13, 2012

Related U.S. Application Data

(63) Continuation-in-part of application No. 13/267,923, filed on Oct. 7, 2011, now Pat. No. 8,276,484.

(30) Foreign Application Priority Data

Jan. 13, 2011 (TW) ..... 100101250
Dec. 22, 2011 (TW) ..... 100224242

(51) Int. Cl.
*B25B 13/20* (2006.01)

(52) U.S. Cl.
USPC ..... 81/165; 81/126; 81/170; 81/133

(58) Field of Classification Search
USPC ..... 81/165, 133–135, 145, 170, 157
See application file for complete search history.

(56) References Cited

U.S. PATENT DOCUMENTS

| | | | | |
|---|---|---|---|---|
| 3,926,077 | A | 12/1975 | Nordgren | 81/126 |
| 5,297,459 | A | 3/1994 | Stojanowski | 81/165 |
| 6,089,129 | A | 7/2000 | Huang | 81/133 |
| 6,336,384 | B1 | 1/2002 | Huang | 81/165 |
| 6,418,819 | B1 * | 7/2002 | Kuo | 81/165 |
| 7,137,321 | B1 | 11/2006 | Huang | 81/126 |
| 8,136,429 | B2 | 3/2012 | Wu | 81/165 |
| 8,276,484 | B2 * | 10/2012 | Huang | 81/165 |
| 2011/0167967 | A1 | 7/2011 | Chen | 81/177.8 |
| 2012/0055292 | A1 | 3/2012 | Cheng | 81/165 |

* cited by examiner

*Primary Examiner* — Monica Carter
*Assistant Examiner* — Melanie Alexander
(74) *Attorney, Agent, or Firm* — Alan Kamrath; Kamrath IP Lawfirm, P.A.

(57) ABSTRACT

An adjustable wrench includes a fixed jaw, a movable jaw, and a handle, and a lock mechanism. The fixed jaw includes an adjusting mechanism and an abutting mechanism disposed therein. The adjusting mechanism includes a worm gear, with the worm gear rotatable about and movable along a fixing member. The abutting mechanism includes an abutting member pivotally fixed and including an end engagable with the worm gear. The movable jaw is engaged with the worm gear and moves linearly relative to the fixed jaw upon rotating the worm gear. The handle is pivotally fixed to the fixed jaw. The lock mechanism is installed between the fixed jaw and the handle and operable to a lock position a relative pivotal movement between the fixed jaw and the handle is obstructed and to an unlock position the fixed jaw and the handle are able to pivot relative to each other.

20 Claims, 15 Drawing Sheets

ADJUSTABLE WRENCH

CROSS REFERENCE

The present application is a continuation-in-part application of U.S. patent application Ser. No. 13/267,923, filed on Oct. 7, 2011, now U.S. Pat. No. 8,276,484, of which the entire disclosure is incorporated herein.

BACKGROUND OF THE INVENTION

1. Field of the Invention

The present invention relates to an adjustable wrench and, in particular, to an adjustable wrench for quickly turning an object.

2. Description of the Related Art

U.S. Pat. No. 6,336,384 shows an adjustable wrench for quickly turning an object. The adjustable wrench includes a main body, a slide block, a movable jaw and a grip. The main body includes a jaw section and a hollow section. The slide block and the movable jaw are disposed in the hollow section. The grip is pivotally connected with the hollow section. A movable retaining block is disposed on one side of the top end of the grip and is opposite to a leaning section of the slide block. The retaining block can be switched. When the grip is wrenched in different directions, the retaining block abuts against and pushes the leaning section of the slide block to move the movable jaw toward the jaw section of the main body for clamping and wrenching a work piece. When the retaining block does not abut against the leaning section, turning the grip with respect to the work piece would cause the work piece to shift the slide block and the movable jaw and to make the main body idle. However, the adjustable wrench is not suitable to a high-torque wrenching operation, as the retaining block, which should be prevented from moving, is liable to move relative to the slide block, and as a detent ball, which is biased by a spring, is liable to disengage from a recessed section of the grip.

The present invention is, therefore, intended to obviate or at least alleviate the problems encountered in the prior art.

SUMMARY OF THE INVENTION

According to the present invention, an adjustable wrench includes a fixed jaw, a movable jaw, and a handle, and a lock mechanism. The fixed jaw includes first and second ends, a chamber and a hole defined therein, with the hole extended from the chamber to an outer periphery of the fixed jaw, with the chamber including an adjusting mechanism and an abutting mechanism disposed therein, with the adjusting mechanism including a worm gear, a fixing member, and a first biasing member, with the worm gear including the fixing member inserted therein, with the worm gear rotatable about and movable along the fixing member, with the fixing member inserted through the hole, with the first biasing member engaged with the worm gear, with the abutting mechanism including an abutting member, with the abutting member pivotally fixed and including an end engagable with the worm gear, wherein the chamber forms a concavity receiving the abutting member, with the abutting member defining a fixing end and first and second engaging ends, with the concavity pivotally bearing the fixing end.

The movable jaw is movably received in the second end of the fixed jaw and engaged with the worm gear, with the movable jaw moving linearly relative to the fixed jaw upon rotating the worm gear. The handle is pivotally fixed to the fixed jaw and allowing grasping by a user. The lock mechanism is installed between the fixed jaw and the handle and operable to a lock position a relative pivotal movement between the fixed jaw and the handle is obstructed and to an unlock position the fixed jaw and the handle are able to pivot relative to each other.

The lock mechanism is in the unlock position, the adjustable wrench is operable in a first direction wrenching an object and including the worm gear stopped from moving along the fixing member by the abutting member fixedly abutting against the worm gear, with the adjustable wrench operably moved in the first direction including the second engaging end abutted against the worm gear.

The lock mechanism is in the unlock position, the adjustable wrench is operable in a second direction moving relative to the object and including the worm gear adapted to be moved with respect to the fixing member and including the movable jaw moving with respect to the fixed jaw and including the abutting member not fixedly abutted against the worm gear.

The lock mechanism is in the lock position, the adjustable wrench is operable in either the first and second directions wrenching the object.

Therefore, it is an objective of the present invention to provide an adjustable wrench for quickly turning an object It is an objective of the present invention to provide an adjustable wrench having a satisfactory structural strength.

It is another objective of the present invention to provide an adjustable wrench usable in a circumstance which requires a relatively large torque to turn an object.

It is further object of the present invention to provide an adjustable wrench with a lock mechanism.

Other objectives, advantages, and new features of the present invention will become apparent from the following detailed description of the invention when considered in conjunction with the accompanied drawings.

DETAILED DESCRIPTION OF THE PREFERRED EMBODIMENTS

Figure 1:
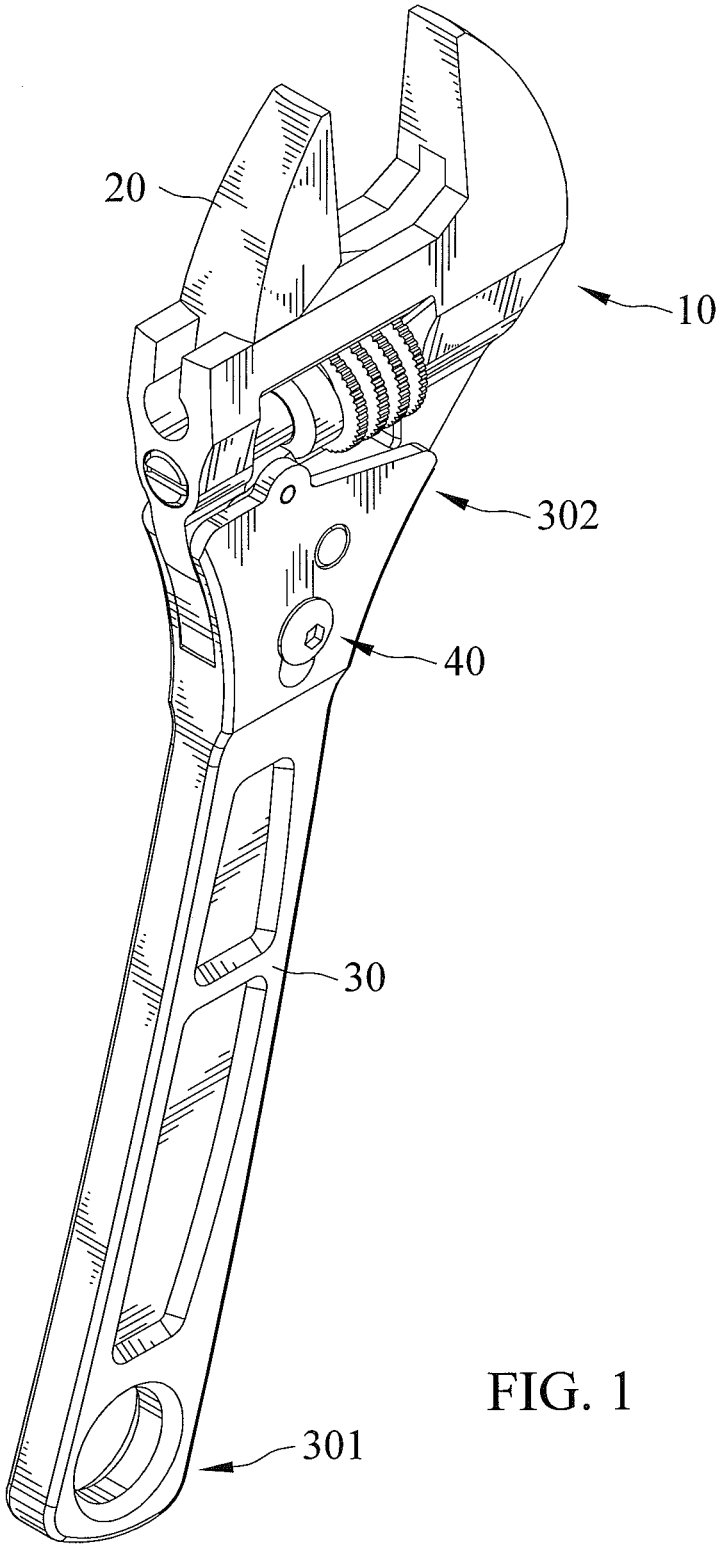
FIG. 1 is a perspective view of an adjustable wrench in accordance with a first embodiment of the present invention.
Figure 2:
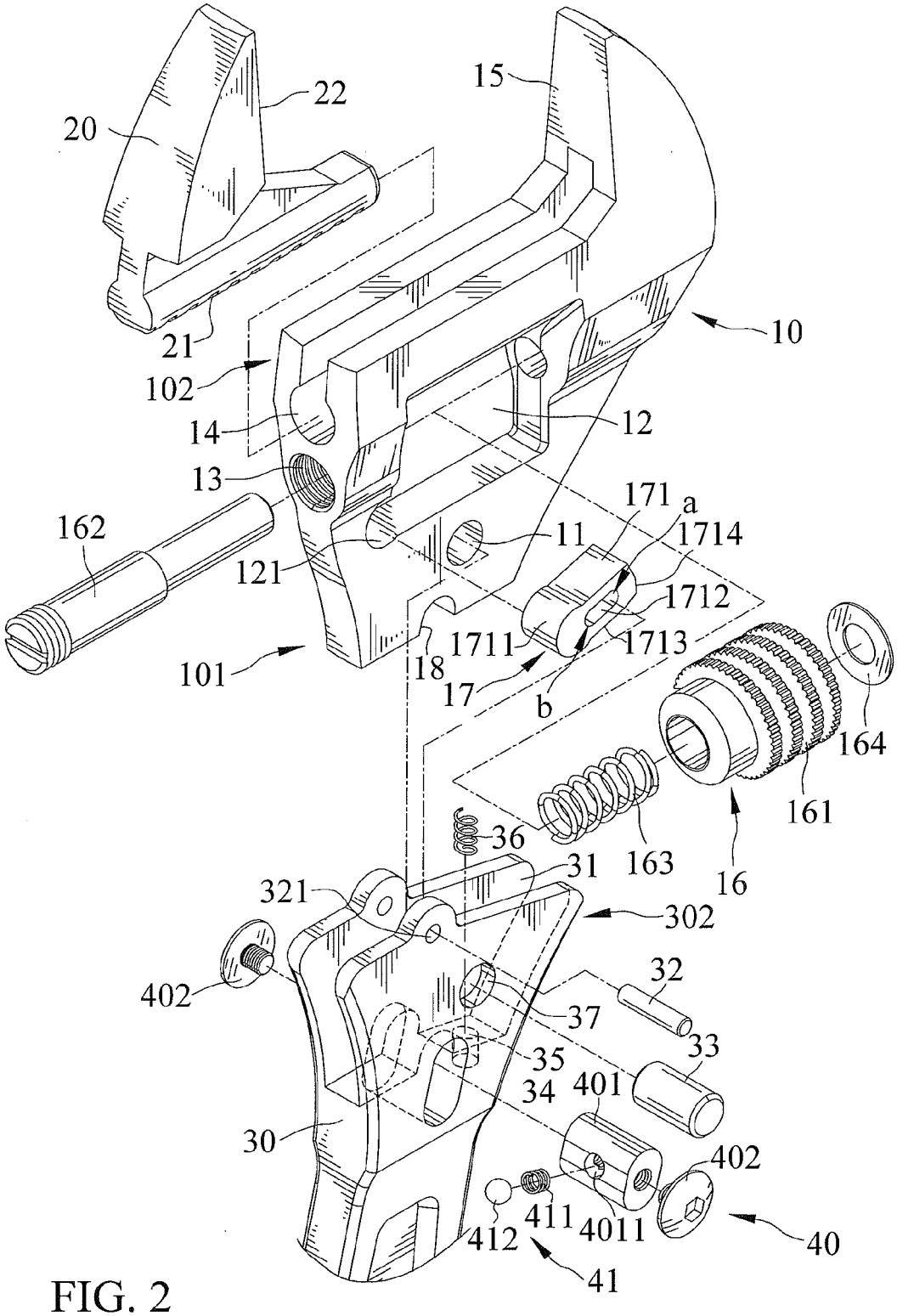
FIG. 2 is an exploded perspective view of the adjustable wrench of FIG. 1.
Figure 3:
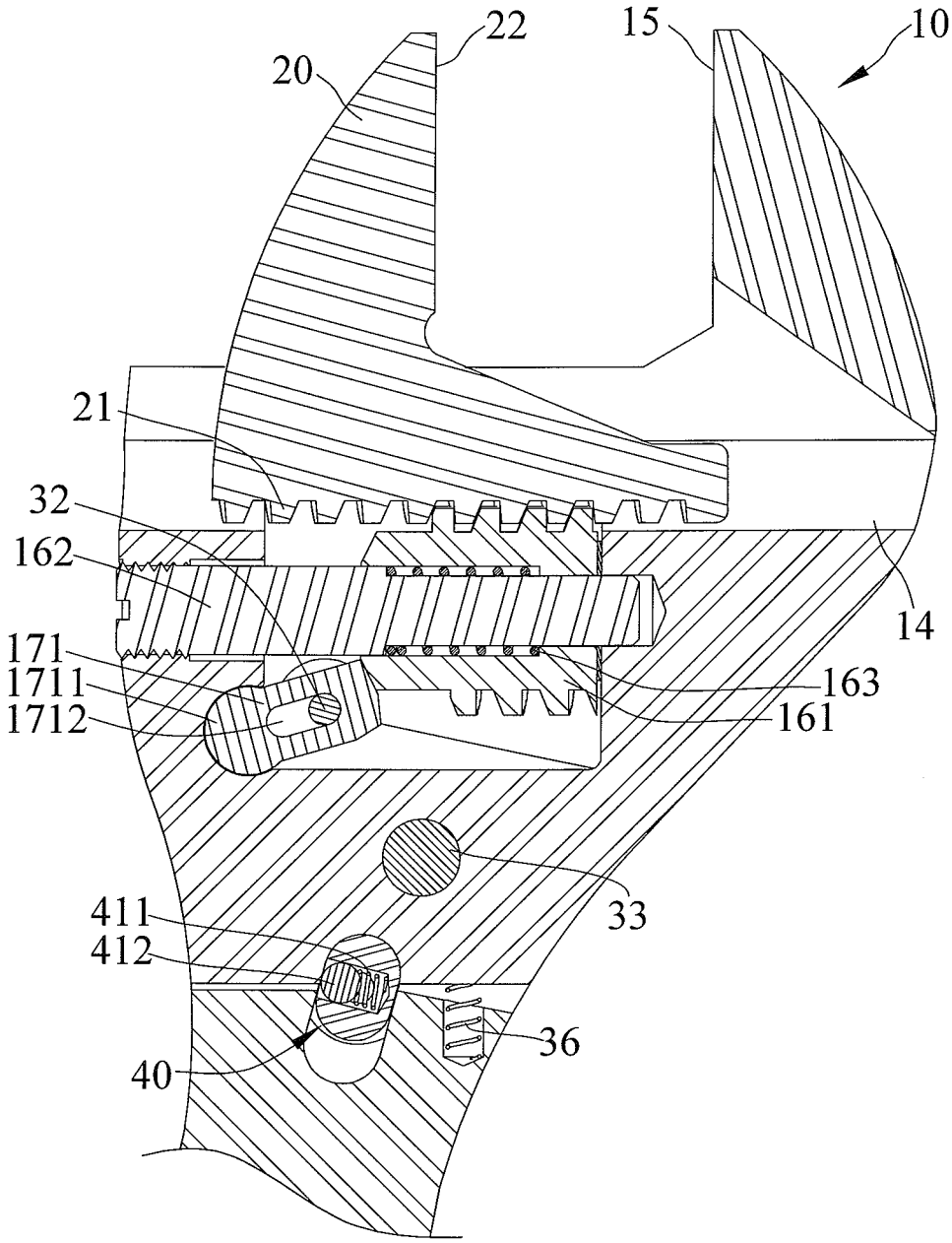
FIG. 3 is a cross-sectional view of the adjustable wrench of FIG. 1.
Figure 4:
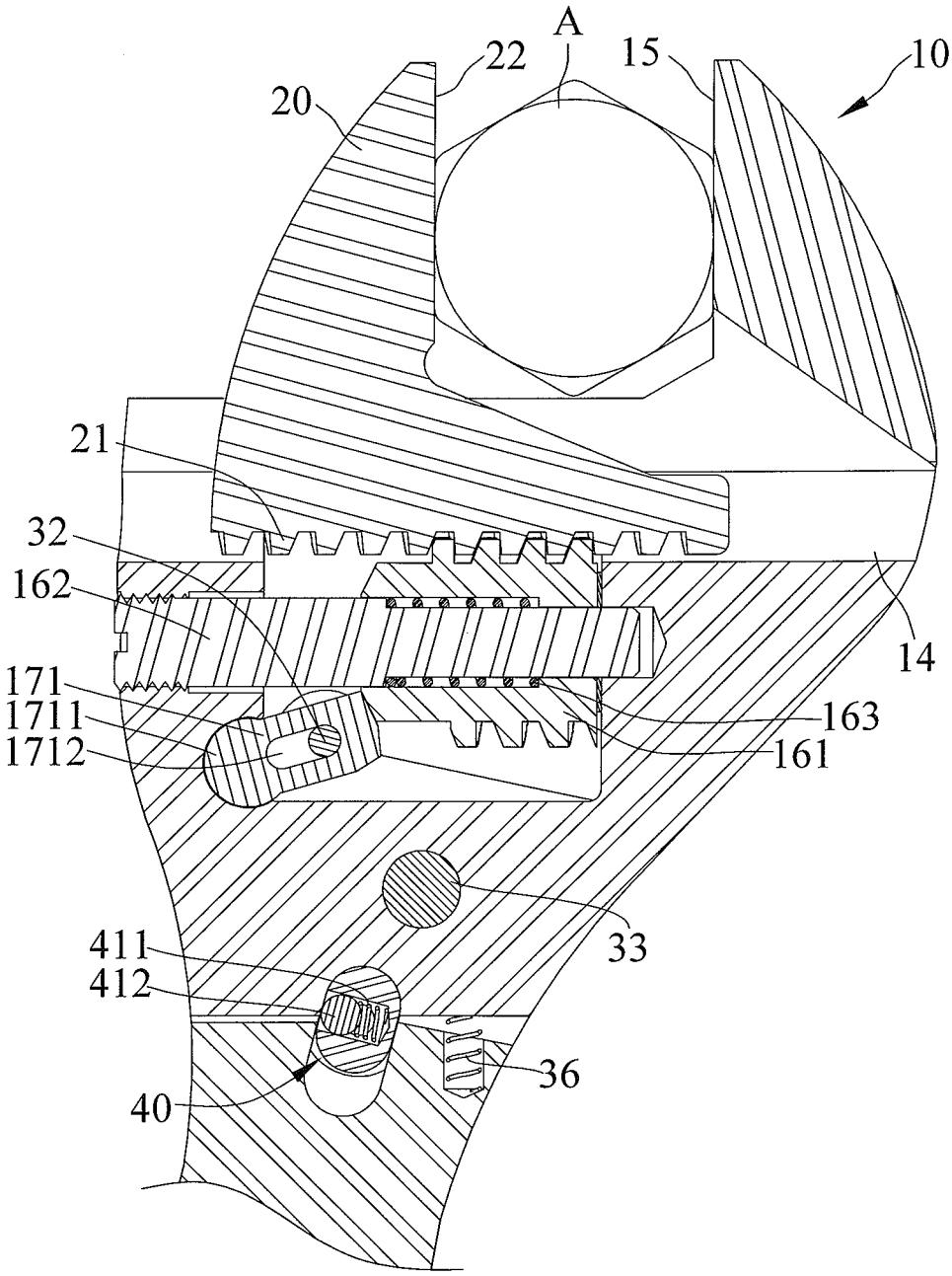
FIG. 4 is an extended cross-sectional view of FIG. 3, showing an object disposed between a fixed jaw and a movable jaw of the adjustable wrench.
Figure 5:
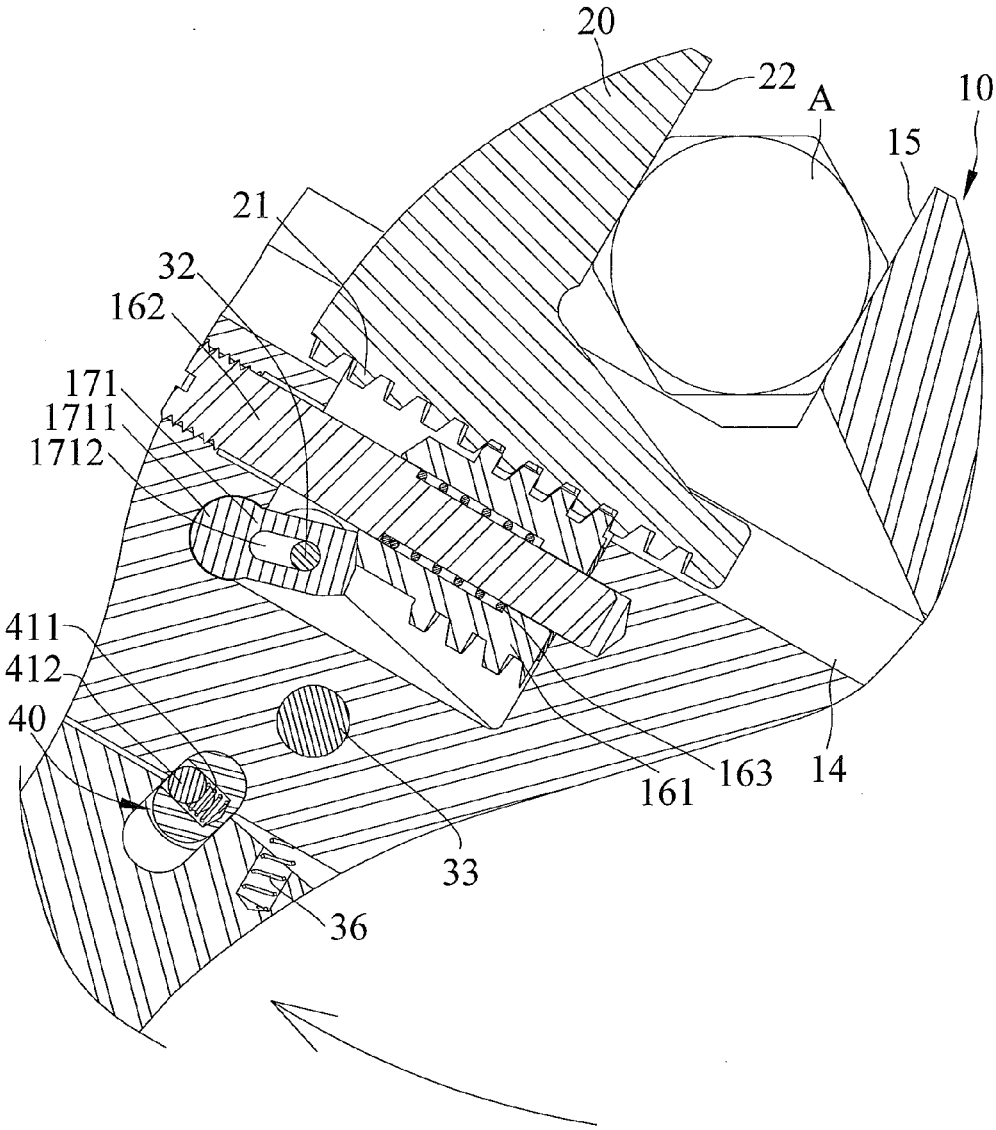
FIG. 5 is a continued view of FIG. 4, showing the operation of the adjustable wrench in a first operating direction wrenching the object, with the lock mechanism of the adjustable wrench in a lock position.
Figure 6:
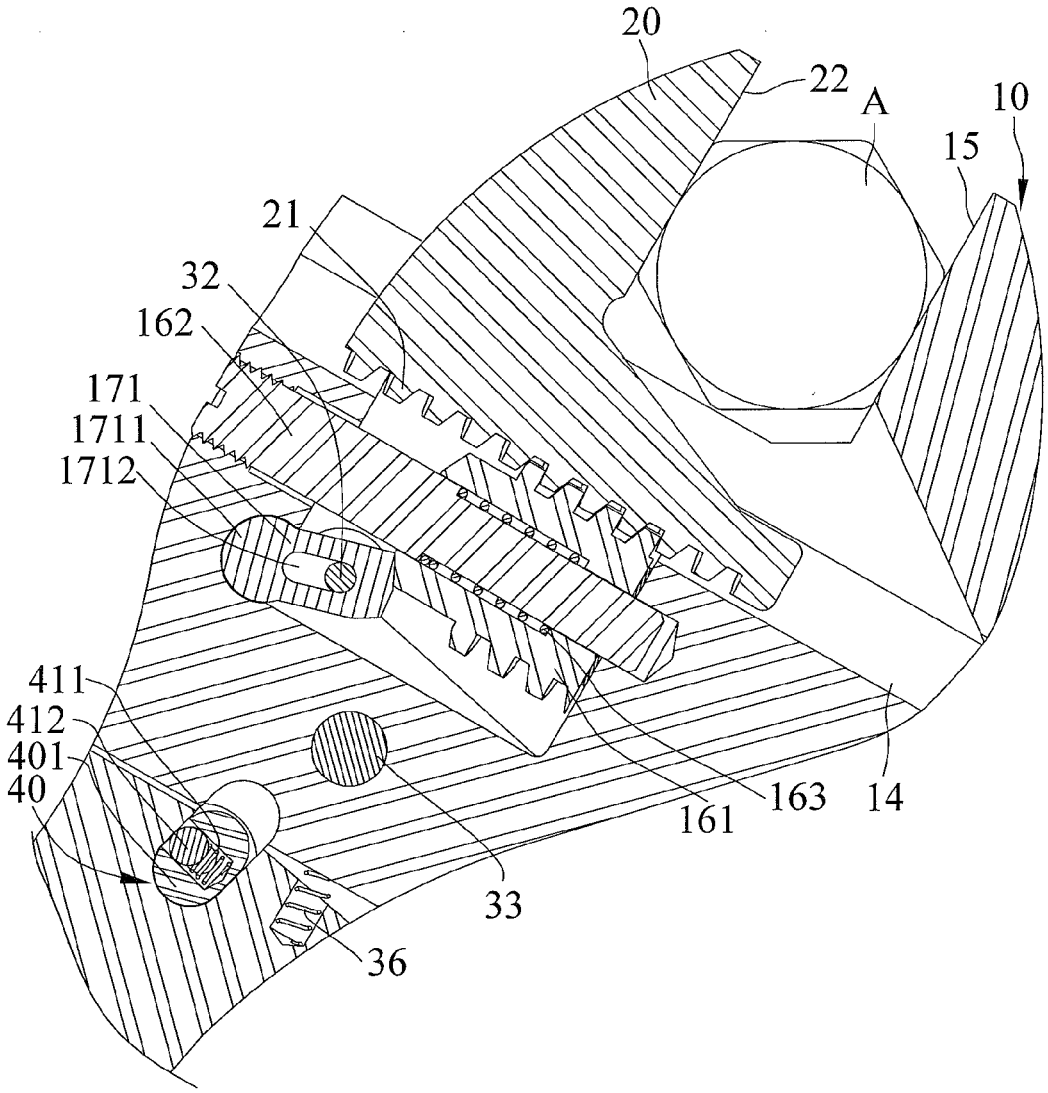
FIG. 6 is a cross-sectional view similar to FIG. 5, except with the lock mechanism in an unlock position.
Figure 7:
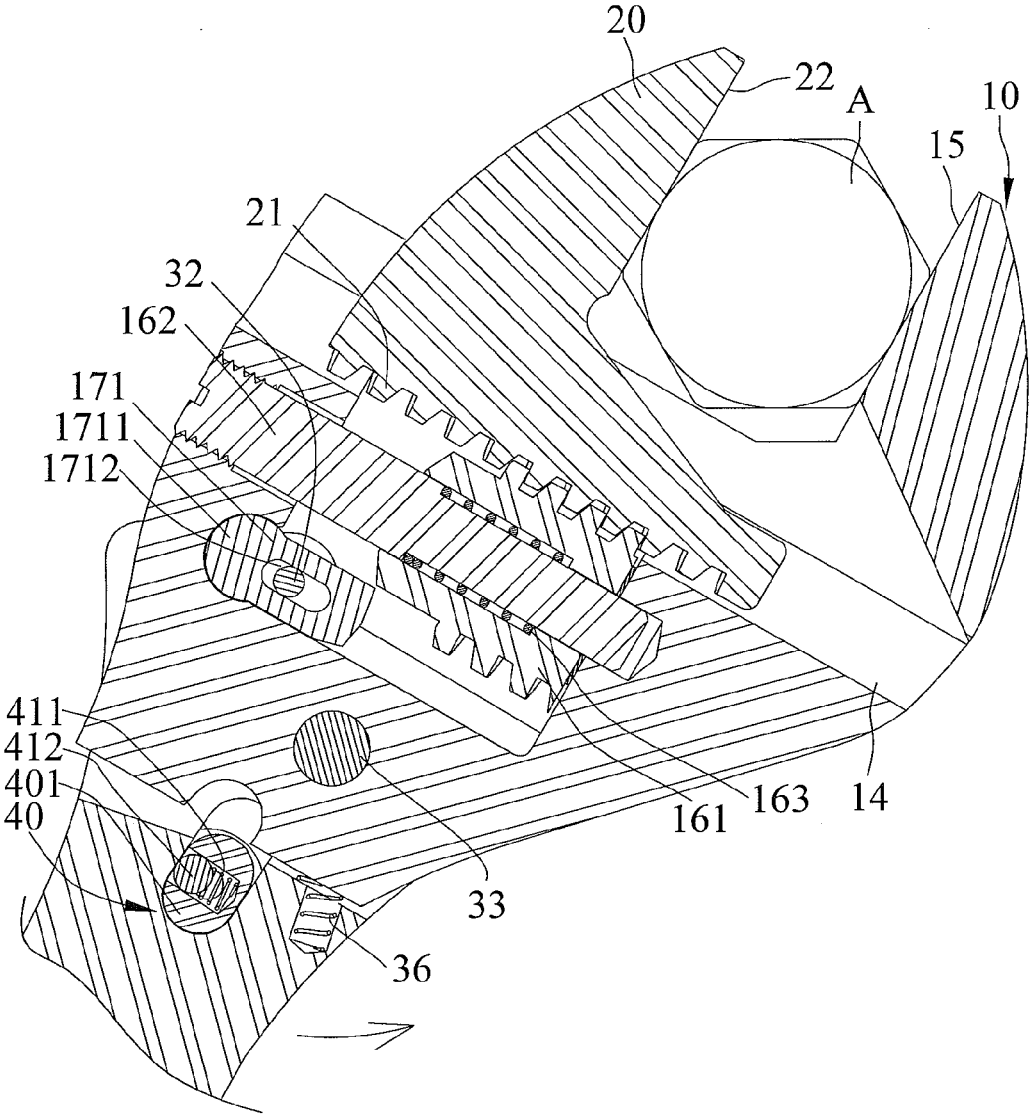
FIG. 7 is a continued view of FIG. 6, showing the operation of the adjustable wrench in a second operating direction moving relative to the object moving relative to the object engaged therewith.
Figure 8:
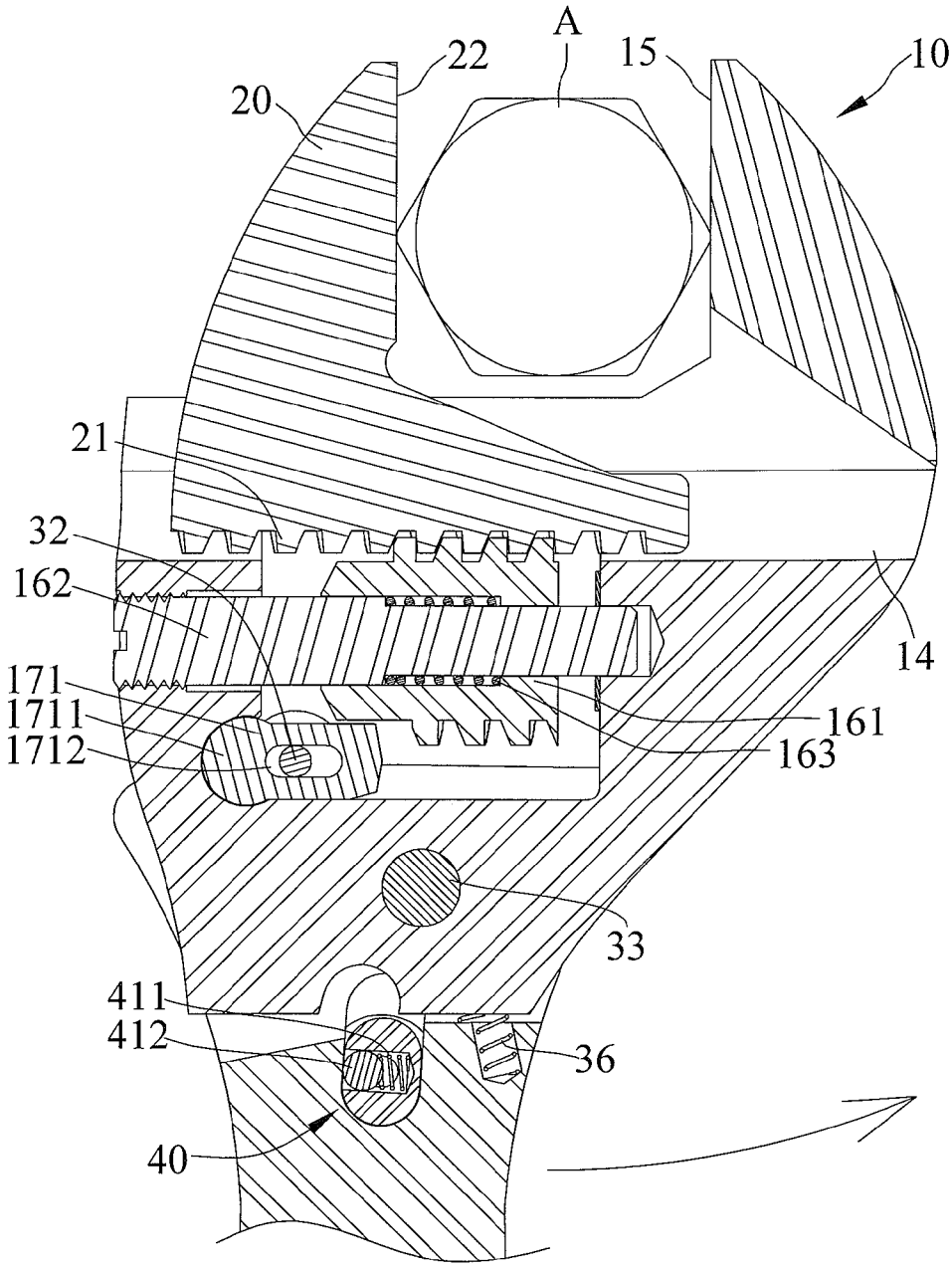
FIG. 8 is a continued view of FIG. 7, showing the operation of the adjustable wrench in the second operating direction moving relative to the object moving relative to the object engaged therewith.
Figure 9:
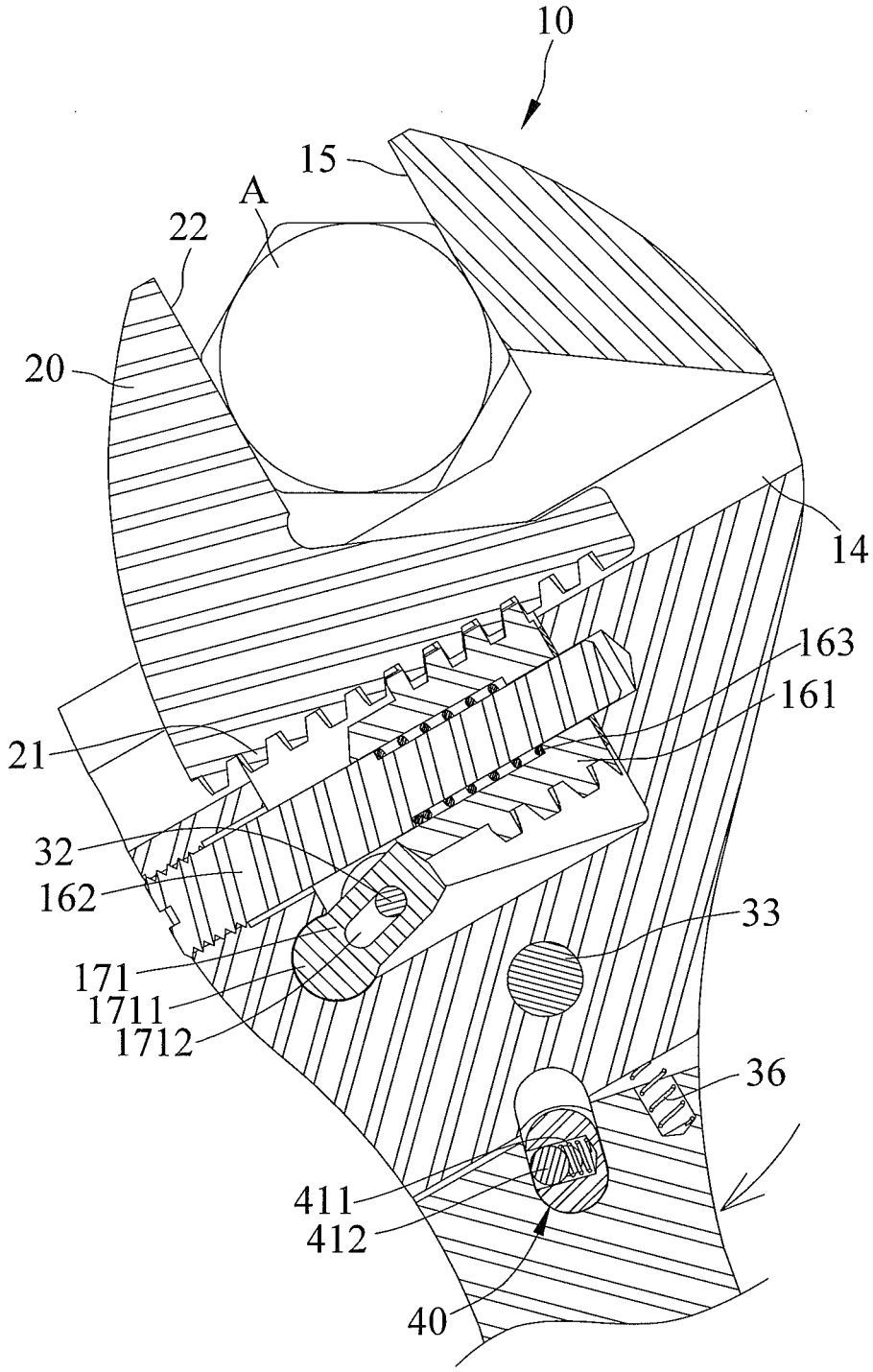
FIG. 9 is a continued view of FIG. 8, showing the operation of the adjustable wrench in the first operating direction for wrenching the object engaged therewith.

FIGS. 1 through 9 show an adjustable wrench in accordance with a first embodiment of the present invention. The adjustable wrench includes a fixed jaw 10, a movable jaw 20, and a handle 30, and a lock mechanism 40.

The fixed jaw 10 includes first and second ends 101 and 102, a first orifice 11, a chamber 12 a hole 13, and a groove 14 defined therein. The fixed jaw 10 defines a first clamping face 15. The hole 13 is extended from the chamber 12 to an outer periphery of the fixed jaw 10. The chamber 12 includes an adjusting mechanism 16 and an abutting mechanism 17 disposed therein. The adjusting mechanism 16 includes a worm gear 161, a fixing member 162, a first biasing member 163, and a spacer 164. The worm gear 161 includes the fixing member 162 inserted therein. The worm gear 161 is rotatable about and movable along the fixing member 162. The fixing member 162 is inserted through the hole 13. The first biasing member 163 is engaged with the worm gear 161. The spacer 164 is disposed between an end of the worm gear 161 and a peripheral wall of the chamber 12. The abutting mechanism 17 includes an abutting member 171. The abutting member 171 is pivotally fixed and includes an end engagable with the worm gear 161. The chamber 12 forms a concavity 121 receiving the abutting member 171, with the abutting member 171 defining a fixing end 1711 and first and second engaging ends 1713 and 1714, and with the concavity 121 pivotally bearing the fixing end 1711. The abutting member 171 also includes two opposite lateral sides and a first bore 1712 extended through the lateral sides. The first bore 1712 is in the form of a slot and defines first and second limiting ends "a" and "b". The fixed jaw 10 includes a recess 18 extended in the first end 101.

The movable jaw 20 is movably received in the groove 14 defined in the second end 102 of the fixed jaw 10 and engaged with the worm gear 161. The movable jaw 20 moves linearly relative to the fixed jaw 10 upon rotating the worm gear 161. The movable jaw 20 includes a plurality of engaging teeth 21 disposed in the groove 14 and engaging with gears of the worm gear 161. The movable jaw 20 defines a second clamping face 22 corresponding to the first clamping face 15.

The handle 30 is pivotally fixed to the fixed jaw 10 and allowing grasping by a user. The handle 30 includes a proximal end defining a connecting end 301 including the fixed jaw 10 pivotally joined thereto and a distal end defining a grasping end 302 allowing grasping by a user. The handle 30 includes a gap 31 defined between two sides, and the first end 101 of the fixed jaw 10 is received in the gap 31. The sides of the handle 30 include a second bore 321 extended therethrough. Further, a fastener 32 is inserted through the two lateral sides of the abutting member 171 and includes an end extending out of one lateral side and joined to one side of the handle 30 and another end extending out of the other lateral side and joined to the other side of the handle 30 respectively. Moreover, the first bore 1712 has a diameter, which extends from the first to the second limiting ends "a" and "b", larger than and a diameter of the fastener 32. The second bore 321 has a diameter substantially equal to the diameter of the fastener 32. The handle 30 includes a cavity 34 defined therein connected to the recess 18. The handle 30 also includes a notch 35 and a second orifice 37 defined therein. The fixed jaw 10 and the handle 30 include a second biasing member 36 engaged therebetween and received in the notch 35. The fixed jaw 10 and the handle 30 pivotally move about a pivot 33, with the pivot 33 engaged in the first and second orifices 11 and 37.

The lock mechanism 40 is installed between the fixed jaw 10 and the handle 30 and operable to a lock position a relative pivotal movement between the fixed jaw 10 and the handle 30 is obstructed and to an unlock position the fixed jaw 10 and the handle 30 are able to pivot relative to each other. The lock mechanism 40 in the lock position is extended into the recess 18 and the cavity 34. Additionally, the lock mechanism 40 in the unlock position is disposed in the cavity 34 and not extended into the recess 18. The lock mechanism 40 includes a switch 401. The switch 401 has a body, with the lock mechanism in the lock position includes the body of the switch 401 extended into the recess 18 and the cavity 34. The switch 401 includes at least one input end 402. The at least one input end 402 is exposed from an opening of the cavity 34. The at least one input end 402 is in the form of a cap. The at least one input end 402 is threadly engaged with the body of the switch 401.

The lock mechanism 40 further includes a detent mechanism 41 retaining the switch 401. The switch includes an aperture 4011 defined therein including an opening on an outer periphery of the body of the switch 401 and receiving the detent mechanism 41. The detent mechanism 41 includes a biasing component 411 and a detent member 412 biased by the biasing component 411 and including an end exposed from the opening of the aperture 4011. The detent member 412 is in the shape of a sphere.

An object "A" is clamped between the first and second clamping faces 15 and 22. The lock mechanism 40 is in the unlock position, the adjustable wrench is operable in a first direction wrenching the object "A" and including the fastener 32 abutted against the first limiting end "a" and the worm gear 161 stopped from moving along the fixing member 162 by the abutting member 171 fixedly abutting against the worm gear 161, with the second engaging end 1714 abutted against the worm gear 161.

The lock mechanism 40 is in the unlock position, the adjustable wrench is operable in a second direction moving relative to the object "A" and including the worm gear 161 adapted to be moved with respect to the fixing member 162 and including the movable jaw 20 moving with respect to the fixed jaw 10 and including the abutting member 171 not fixedly abutted against the worm gear 161 and the fastener 32 moving between the first and second limiting ends "a" and "b".

The lock mechanism 40 is in the lock position, the adjustable wrench is operable in either the first and second directions wrenching the object "A".

Figure 10:
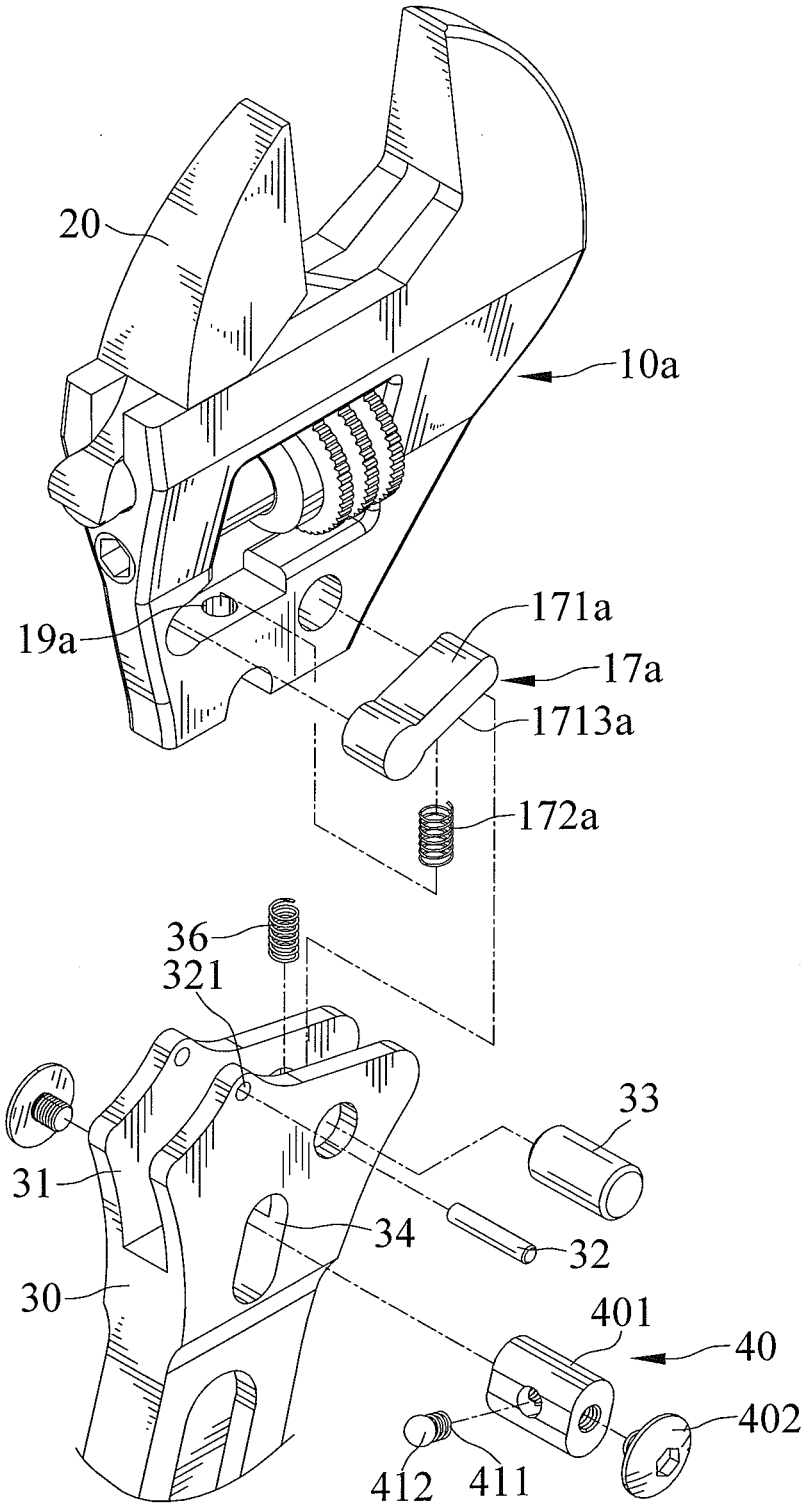
FIG. 10 is an exploded perspective view of an adjustable wrench in accordance with a second embodiment of the present invention.
Figure 11:
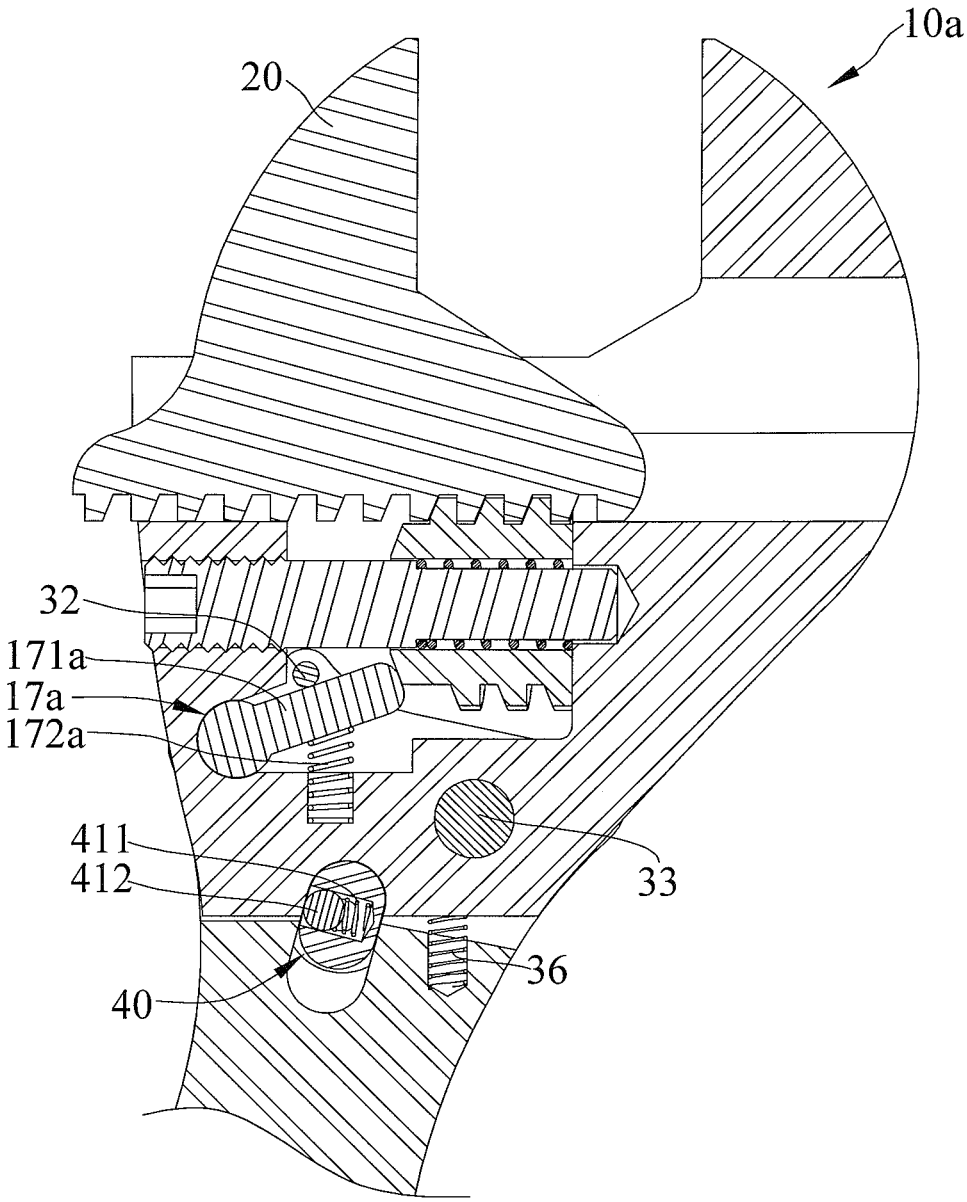
FIG. 11 is a cross-sectional view of the adjustable wrench of FIG. 10.

FIGS. 10 and 11 show an adjustable wrench in accordance with a second embodiment of the present invention. The second embodiment differentiates from the first embodiment in that it includes a fixed jaw 10*a* different from the fixed jaw 10, and an abutting mechanism 17*a* different from the abutting mechanism 17. The fixed jaw 10*a* further includes a receptacle 19*a* defined therein that is not included in the fixed jaw 10. The receptacle 19*a* is connected to the chamber 12.

The abutting mechanism 17*a* includes an abutting member 171*a* and a biasing element 172*a* engaged therewith. The abutting member 171*a* is modified from the abutting member 171 by eliminating the first bore 1712. The biasing element 172*a* includes an end engaged in the receptacle 19*a* and another end abutted against a first engaging end 1713*a* of the abutting member 171*a*.

The adjustable wrench operably moved in the first direction and with the lock mechanism 40 in the unlock position includes the fastener 32 positioned still and abutted against an upper edge of the abutting member 171*c*, which is opposite to the first engaging end 1713*a*. The adjustable wrench operably moved in the second direction and with the lock mechanism in the unlock position includes the fastener 32 moving against the upper edge.

Figure 12:
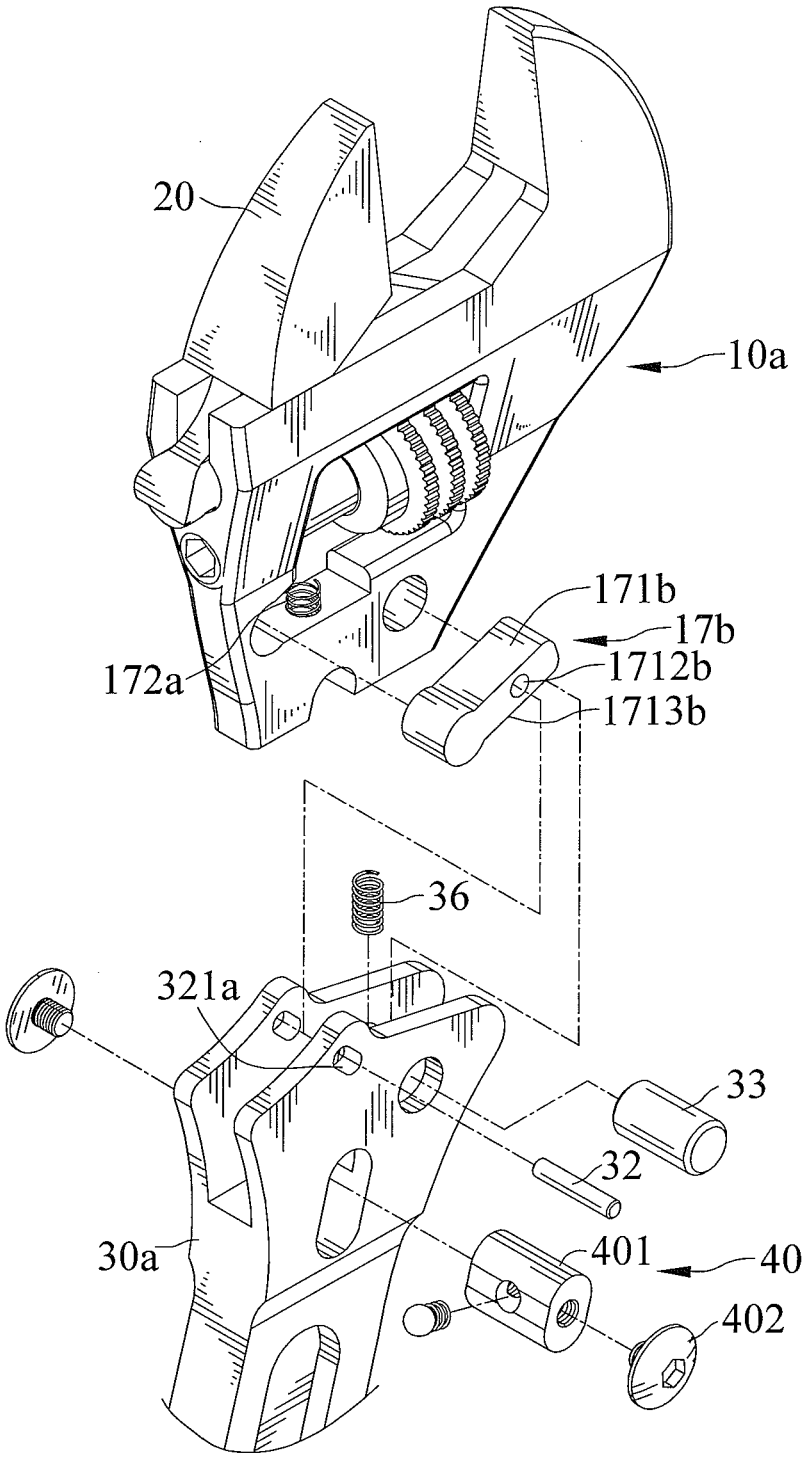
FIG. 12 is an exploded perspective view of an adjustable wrench in accordance with a third embodiment of the present invention.
Figure 13:
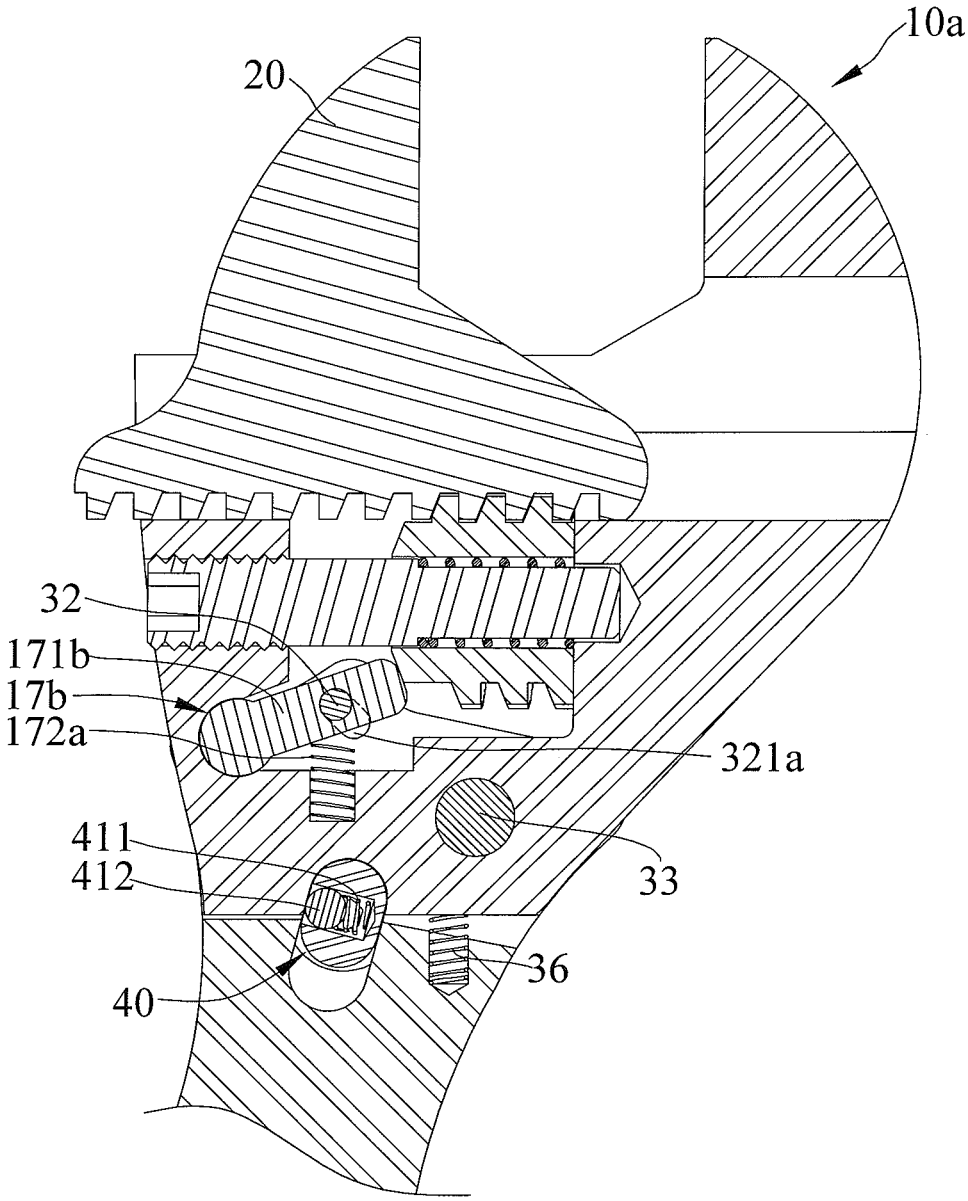
FIG. 13 is a cross-sectional view of the adjustable wrench of FIG. 12.

FIGS. 12 and 13 show an adjustable wrench in accordance with a third embodiment of the present invention. The third embodiment differentiates from the first embodiment in that it utilizes the fixed jaw 10 of the second embodiment, an abutting mechanism 17*b* different from the abutting mechanism 17, and a handle 30*a* different from the handle 30. The handle 30*a* includes two sides and a second bore 321*a* extended through the sides. The abutting mechanism 17*b* includes a first bore 1712*b* in the form of a slot. The first bore 1712*b* has a diameter substantially equal to a diameter of the fastener 32. The second bore 321*a* has a diameter larger than the diameter of the fastener 32. The adjustable wrench operably moved in the first direction and with the unlock mechanism in the unlock position includes the fastener 32 abutted against an end of the second bore 321*a*. The adjustable wrench operably moved in the second direction and with the lock mechanism in the unlock position includes the fastener 32 moving in the second bore 321*a*.

Figure 14:
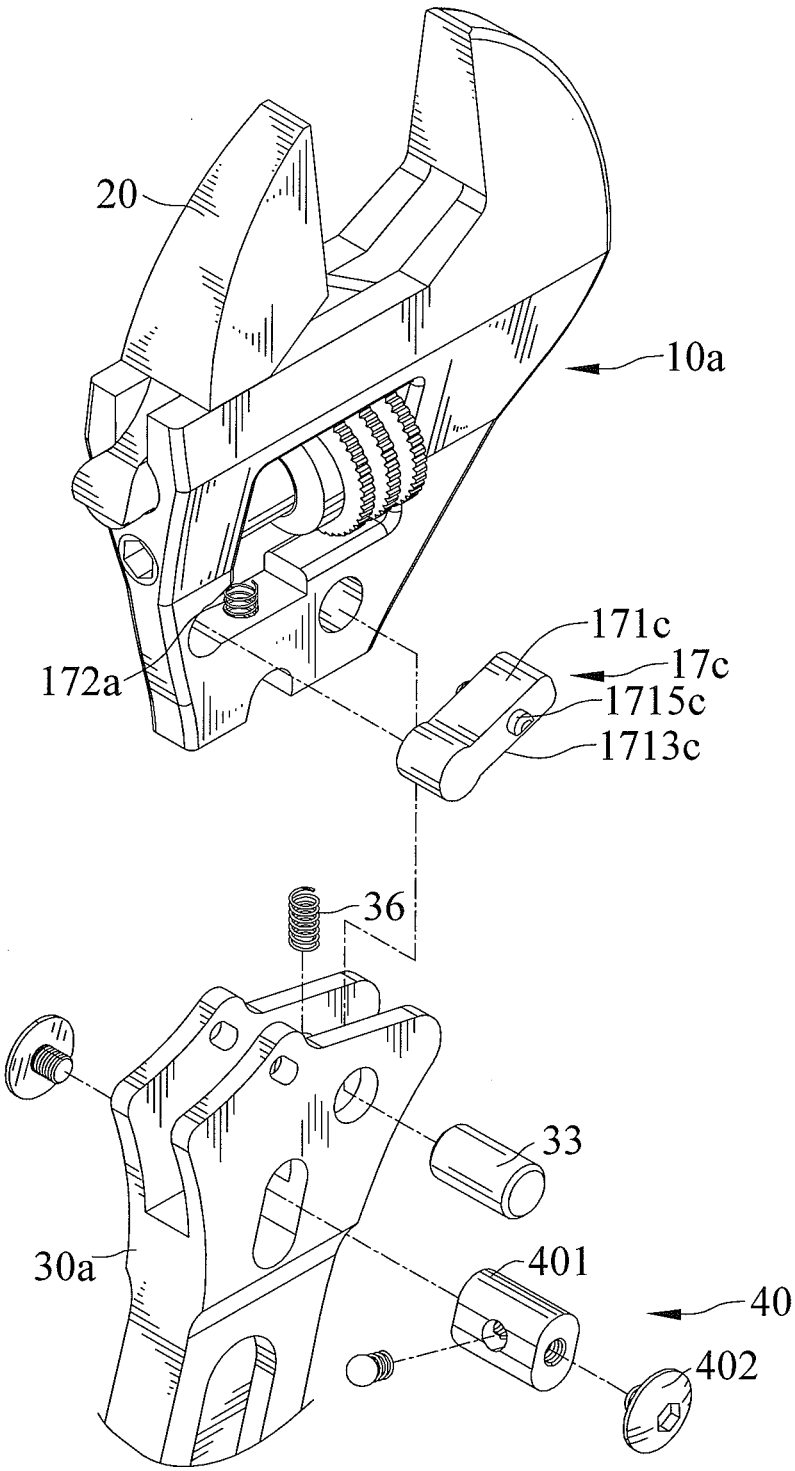
FIG. 14 is an exploded perspective view of an adjustable wrench in accordance with a fourth embodiment of the present invention.
Figure 15:
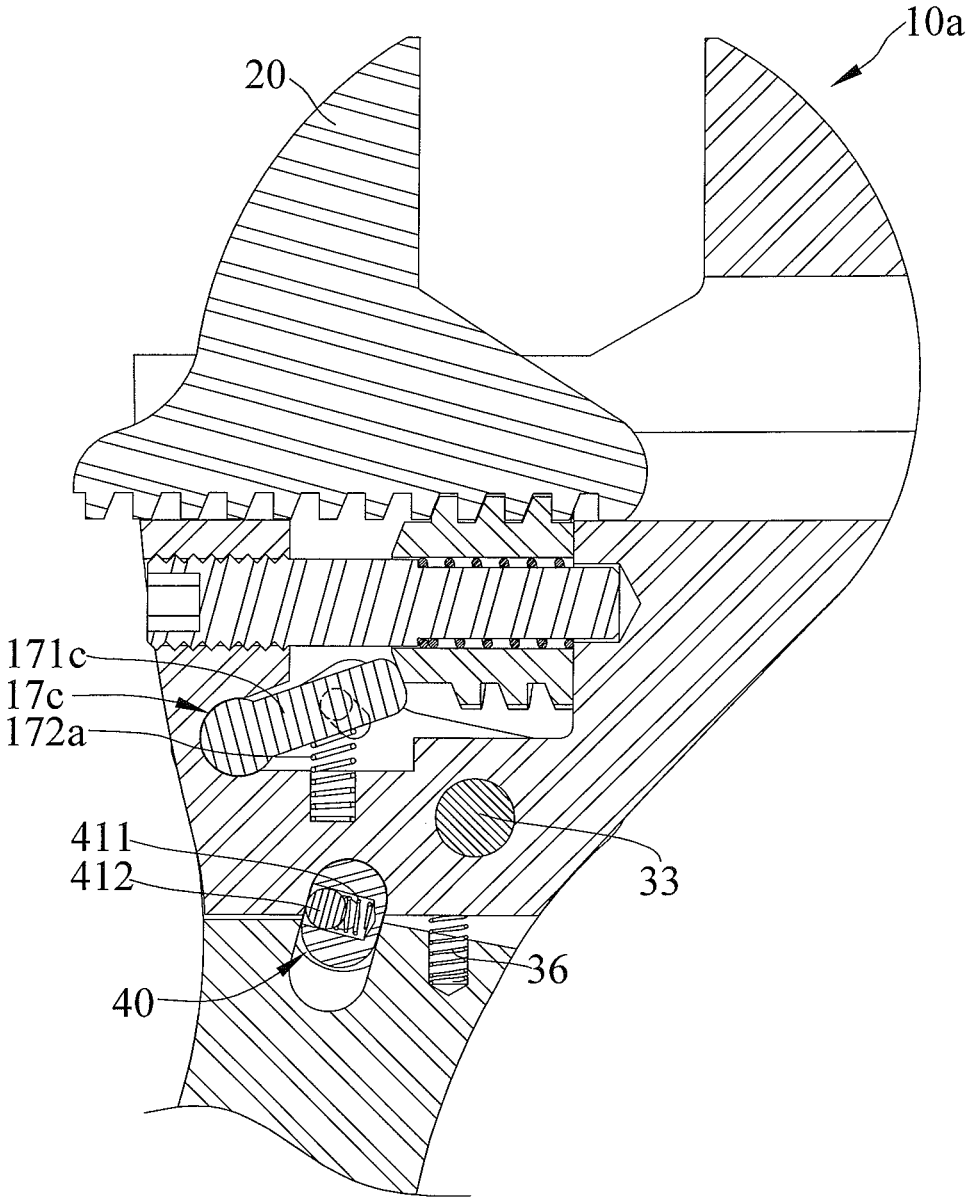
FIG. 15 is a cross-sectional view of the adjustable wrench of FIG. 14.

FIGS. 14 and 15 show an adjustable wrench in accordance with a fourth embodiment of the present invention. The fourth embodiment is similar to the third embodiment except that it includes an abutting mechanism 17*c* different from the abutting mechanism 17*b*. The abutting mechanism 17*c* includes an abutting member 171*c*, which is a one piece structure including two opposite lateral sides and a protrusion 1715*c* extended out of each lateral side, with the protrusion 1715*c* joined to a side of the handle 30*a*.

While the specific embodiments have been illustrated and described, numerous modifications come to mind without significantly departing from the spirit of invention, and the scope of invention is only limited by the scope of the accompanying claims.

What is claimed is:

1. An adjustable wrench comprising:

a fixed jaw including first and second ends, a chamber and a hole defined therein, with the hole extended from the chamber to an outer periphery of the fixed jaw, with the chamber including an adjusting mechanism and an abutting mechanism disposed therein, with the adjusting mechanism including a worm gear, a fixing member, and a first biasing member, with the worm gear including the fixing member inserted therein, with the worm gear rotatable about and movable along the fixing member, with the fixing member inserted through the hole, with the first biasing member engaged with the worm gear, with the abutting mechanism including an abutting member, with the abutting member pivotally fixed and including an end engagable with the worm gear, wherein the chamber forms a concavity receiving the abutting member, with the abutting member defining a fixing end and first and second engaging ends, with the concavity pivotally bearing the fixing end;

a movable jaw movably received in the second end of the fixed jaw and engaged with the worm gear, with the movable jaw moving linearly relative to the fixed jaw upon rotating the worm gear;

a handle pivotally fixed to the fixed jaw and allowing grasping by a user; and a lock mechanism installed between the fixed jaw and the handle and operable to a lock position a relative pivotal movement between the fixed jaw and the handle is obstructed and to an unlock position the fixed jaw and the handle are able to pivot relative to each other; and wherein the lock mechanism is in the unlock position, the adjustable wrench is operable in a first direction wrenching an object and including the worm gear stopped from moving along the fixing member by the abutting member fixedly abutting against the worm gear, with the adjustable wrench operably moved in the first direction including the second engaging end abutted against the worm gear; and wherein the lock mechanism is in the unlock position, the adjustable wrench is operable in a second direction moving relative to the object and including the worm gear adapted to be moved with respect to the fixing member and including the movable jaw moving with respect to the fixed jaw and including the abutting member not fixedly abutted against the worm gear; and wherein the lock mechanism is in the lock position, the adjustable wrench is operable in either the first and second directions wrenching the object.

2. The adjustable wrench as claimed in claim 1, wherein the abutting member includes two opposite lateral sides, wherein the abutting member includes a fastener inserted therein and including an end extending out of one lateral side and joined to a side of the handle and another end extending out of the other lateral side and joined to another side of the handle respectively, wherein the handle includes a gap defined between the sides, and wherein the first end of the fixed jaw is received in the gap.

3. The adjustable wrench as claimed in claim 2 further comprising a biasing element, wherein the abutting member is engaged with the biasing element.

4. The adjustable wrench as claimed in claim 3, wherein the chamber is connected to a receptacle, and wherein the biasing element includes an end engaged in the receptacle and another end abutted against the first engaging end of the abutting member.

5. The adjustable wrench as claimed in claim 2, wherein the abutting member includes a first bore extended through the two lateral sides, wherein the first bore is in the form of a slot and defines first and second limiting ends, wherein the sides of the handle include a second bore extended therethrough, wherein the first bore has a diameter, which extends from the first to the second limiting ends, larger than and a diameter of the fastener, wherein the second bore has a diameter substantially equal to the diameter of the fastener, wherein the adjustable wrench operably moved in the first direction and with the lock mechanism in the unlock position includes the fastener abutted against the first limiting end, and wherein the adjustable wrench operably moved in the second direction and with the lock mechanism in the unlock position includes the fastener moving between the first and second limiting ends.

6. The adjustable wrench as claimed in claim 3, wherein the sides of the handle include a second bore extended therethrough, wherein the first bore is in the form of a slot, wherein the first bore has a diameter substantially equal to a diameter of the fastener, wherein the second bore has a diameter larger than the diameter of the fastener, wherein the adjustable wrench operably moved in the first direction and with the unlock mechanism in the unlock position includes the fastener abutted against an end of the second bore, and wherein the adjustable wrench operably moved in the second direction and with the lock mechanism in the unlock position includes the fastener moving in the second bore.

7. The adjustable wrench as claimed in claim 1, wherein the abutting member is a one piece structure including two opposite lateral sides and a protrusion extended out of each lateral side, with the protrusion joined to a side of the handle, wherein the handle includes a gap defined between the sides, and wherein the first end of the fixed jaw is received in the gap, and wherein the abutting member is engaged with a biasing element.

8. The adjustable wrench as claimed in claim 7, wherein the sides of the handle include a second bore extended therethrough, wherein the second bore has a diameter larger than a diameter of the protrusion, wherein the adjustable wrench operably moved in the first direction and with the lock mechanism in the unlock position includes the protrusions abutted against an end of the second bore, and wherein the adjustable wrench operably moved in the second direction and with the lock mechanism in the unlock position includes the protrusions moving in the second bore.

9. The adjustable wrench as claimed in claim 1, wherein the handle includes a bore defined therein and a fastener inserted in the bore and including an end joined to a side of the handle and another end joined to another side of the handle respectively, wherein the handle includes a gap defined between the sides, wherein the first end of the fixed jaw is received in the gap, and wherein the abutting member is engaged with a biasing element.

10. The adjustable wrench as claimed in claim 9, wherein the bore has a diameter substantially equal to the diameter of the fastener, wherein the adjustable wrench operably moved in the first direction and with the lock mechanism in the unlock position includes the fastener positioned still and abutted against an upper edge of the abutting member, which is opposite to the first engaging end, and wherein the adjustable wrench operably moved in the second direction and with the lock mechanism in the unlock position includes the fastener moving against the upper edge.

11. The adjustable wrench as claimed in claim 1, wherein the handle includes a notch defined therein, and wherein the fixed jaw and the handle include a second biasing member engaged therebetween and received in the notch.

12. The adjustable wrench as claimed in claim 1, wherein the fixed jaw includes a first orifice and the handle includes a second orifice defined therein respectively, and wherein the fixed jaw and the handle pivotally move about a pivot, with the pivot engaged in the first and second orifices.

13. The adjustable wrench as claimed in claim 1, wherein the second end of the fixed jaw includes a groove defined therein, wherein the movable jaw is movably received in the groove, wherein the fixed jaw defines a first clamping face and the movable jaw defines a second clamping face corresponding to the first clamping face, with the object clamped between the first and second clamping faces.

14. The adjustable wrench as claimed in claim 1 further comprising a spacer disposed between an end of the worm gear and a peripheral wall of the chamber.

15. The adjustable wrench as claimed in claim 1, wherein the fixed jaw includes a recess and the handle includes a cavity defined therein respectively, wherein the recess is connected to the cavity, wherein the lock mechanism in the lock position is extended into the recess and the cavity, and wherein the lock mechanism in the unlock position is disposed in the cavity and not extended into the recess.

16. The adjustable wrench as claimed in claim 15, wherein the lock mechanism includes a switch, with the switch having a body, wherein the lock mechanism in the lock position includes the body of the switch extended into the recess and the cavity, wherein the lock mechanism further includes a detent mechanism engaged in the switch, with the switch including an aperture defined therein including an opening on an outer periphery of the body of the switch and receiving the detent mechanism.

17. The adjustable wrench as claimed in claim 16, wherein the detent mechanism retaining the switch includes a biasing component and a detent member biased by the biasing component and including an end exposed from the opening of the aperture.

18. The adjustable wrench as claimed in claim 17, wherein the detent member is in the shape of a sphere.

19. The adjustable wrench as claimed in claim 16, wherein the switch includes at least one input end, wherein the at least one input end is exposed from an opening of the cavity, wherein the at least one input end is in the form of a cap.

20. The adjustable wrench as claimed in claim 13, wherein the movable jaw includes a plurality of engaging teeth disposed in the groove and engaging with gears of the worm gear.

* * * * *